US005522682A

United States Patent [19]

Egan

[11] Patent Number: 5,522,682

[45] Date of Patent: Jun. 4, 1996

[54] MODULAR WALL BLOCK SYSTEM AND GRID CONNECTION DEVICE FOR USE THEREWITH

[75] Inventor: Philip D. Egan, Atlanta, Ga.

[73] Assignee: The Tensar Corporation, Morrow, Ga.

[21] Appl. No.: 204,941

[22] Filed: Mar. 2, 1994

[51] Int. Cl.[6] ..... E02D 29/02

[52] U.S. Cl. ..... 405/262; 405/284; 405/258

[58] Field of Search ..... 405/258, 262, 405/273, 284, 285, 286; 52/605, 606

[56] References Cited

U.S. PATENT DOCUMENTS

| | | | |
|---|---|---|---|
| Re. 34,314 | 7/1993 | Forsberg . | |
| 262,635 | 8/1888 | Adams . | |
| 274,481 | 3/1888 | Frost . | |
| D. 296,007 | 5/1888 | Forsberg . | |
| D. 296,365 | 6/1888 | Forsberg . | |
| D. 297,464 | 8/1888 | Forsberg . | |
| D. 297,574 | 9/1888 | Forsberg . | |
| D. 297,767 | 9/1888 | Forsberg . | |
| D. 298,463 | 11/1888 | Forsberg . | |
| 312,460 | 2/1888 | Haight . | |
| 319,607 | 6/1888 | Nelson . | |
| 324,126 | 8/1888 | Gay . | |
| 389,660 | 9/1888 | Henderson . | |
| 1,412,582 | 4/1922 | Vaile . | |
| 1,671,895 | 5/1928 | Fritz . | |
| 1,762,343 | 6/1930 | Munster . | |
| 1,992,785 | 2/1935 | Steuer | 52/605 |
| 3,925,994 | 12/1975 | Broms et al. . | |
| 4,116,010 | 9/1978 | Vidal . | |
| 4,193,718 | 3/1980 | Wahrendorf et al. . | |
| 4,273,476 | 6/1981 | Kotulla et al. . | |
| 4,324,508 | 4/1982 | Hilfiker et al. . | |
| 4,341,491 | 7/1982 | Neumann . | |
| 4,343,571 | 8/1982 | Price . | |
| 4,343,572 | 8/1982 | Hilfiker . | |
| 4,374,798 | 2/1983 | Mercer . | |
| 4,391,557 | 7/1983 | Hilfiker et al. . | |
| 4,470,728 | 9/1984 | Broadbent . | |
| 4,476,074 | 10/1984 | Bindhoff . | |
| 4,505,621 | 3/1985 | Hilfiker et al. . | |
| 4,530,622 | 7/1985 | Mercer . | |
| 4,616,959 | 10/1986 | Hilfiker . | |
| 4,661,023 | 4/1987 | Hilfiker . | |
| 4,728,227 | 3/1988 | Wilson et al. . | |
| 4,802,320 | 2/1989 | Forsberg . | |
| 4,824,293 | 4/1989 | Brown et al. . | |
| 4,825,619 | 5/1989 | Forsberg . | |
| 4,832,557 | 5/1989 | Jacobsen . | |
| 4,914,876 | 4/1990 | Forsberg . | |
| 4,920,712 | 5/1990 | Dean, Jr. . | |
| 4,929,125 | 5/1990 | Hilfiker . | |
| 4,952,098 | 8/1990 | Grayson et al. . | |
| 4,993,879 | 2/1991 | Hilfiker . | |
| 4,998,397 | 3/1991 | Orton . | |
| 5,044,834 | 9/1991 | Janopaul, Jr. | 405/286 X |
| 5,064,313 | 11/1991 | Risi et al. . | |
| 5,131,791 | 7/1992 | Kitziller | 405/286 |
| 5,145,288 | 9/1992 | Borcherdt . | |
| 5,214,898 | 6/1993 | Beretta . | |
| 5,257,880 | 11/1993 | Janopaul, Jr. . | |
| 5,417,523 | 5/1995 | Scales . | |

OTHER PUBLICATIONS

Rockwood—Retaining Wall Systems.

Stone Wall Series (Landscape Retaining Wall System).

Newcastle Retaining Wall Systems, "Technical Data", one page.

Newcastle Retaining Wall Systems, "Elements of the System", three pages.

Tensar, "Concrete GeoWall™ Package", Reinforced Soil Retaining Wall Systems, 10 pages.

*Primary Examiner*—Dennis L. Taylor

*Attorney, Agent, or Firm*—Jacobson, Price, Holman & Stern

[57] ABSTRACT

A modular wall block is formed with recesses or troughs in a rearward end of its top and/or bottom surface configured to receive forward portions of a rigid grid connection device. Rearward end portions of the grid connection device extend beyond the rear face of the modular wall blocks. Extended lengths of a polygrid material are then secured to the rearward portions of the grid connection device for reinforcing the fill behind a retaining wall formed from a plurality of courses of said wall blocks. The grid-to-block connection does not rely on the weight or friction of superimposed wall blocks and is particularly effective in sites subject to seismic activity.

33 Claims, 7 Drawing Sheets

MODULAR WALL BLOCK SYSTEM AND GRID CONNECTION DEVICE FOR USE THEREWITH

FIELD OF THE INVENTION

This invention relates to a grid connection device and a modular wall block system incorporating the grid connection device, for mechanically securing extended lengths of a grid-like tie-back sheet to selected courses of the modular wall blocks to form a reinforced retaining wall.

BACKGROUND OF THE INVENTION

Retaining walls are commonly used for architectural and site development applications. The wall facing must withstand very high pressures exerted by backfill soils. Reinforcement and stabilization of the soil backfill is commonly provided by grid-like sheet materials that are placed in layers in the soil fill behind the wall face to interlock with the wall fill soil and create a stable reinforced soil mass. Connection of the reinforcing material to the elements forming the wall holds the wall elements in place and minimizes soil backfill pressures.

A preferred form of grid-like tie-back sheet material used to reinforce the soil behind a retaining wall structure, known as an integral geogrid, is commercially available from The Tensar Corporation of Atlanta, Ga. ("Tensar") and is made by the process disclosed in U.S. Pat. No. 4,374,798 ("the '798 patent"), the subject matter of which is incorporated herein in its entirety by reference. However, other forms of grid-like tie-back sheet materials have also been used as reinforcing means in the construction of retaining walls, and the instant inventive concepts are equally applicable with the use of such materials. In any event, difficulties are encountered in providing a secure interconnection between the reinforcing means and the wall elements, especially in areas of high seismic activity.

In a brochure entitled "Concrete Geowall Package", published by Tensar in 1986, various retaining wall structures are shown using full height cast concrete panels. In one such retaining wall structure short strips, or tabs, of geogrid material, such as shown in the '798 patent, are embedded in the cast wall panels. On site, longer strips of geogrid are used to reinforce the wall fill, creating a stable soil mass. To connect the geogrid tabs to the reinforcing geogrid, the strands of one portion of geogrid are bent to form loops, the loops are inserted between the strands of the other portion of geogrid so that the loops project out of the second portion of geogrid, and a rod is passed through the loops on the opposite side of the second portion to prevent the loops being pulled back through, thereby forming a tight interconnection between the two portions of geogrid, sometimes referred to as a "Bodkin" joint.

Use of full height pre-cast concrete wall panels for wall-facing elements in a retaining wall requires, during construction, that the panels be placed using a crane because they are very large, perhaps 2 by 12 feet or even larger and, as a result, are quite heavy such that they cannot be readily man-handled. To avoid such problems in the use of pre-cast wall panels other types of retaining wall structures have been developed. For example, retaining walls have been formed from modular wall blocks which are typically relatively small cementitious blocks as compared to cast wall panels. The assembly of modular wall blocks usually does not require heavy equipment. Such modular wall blocks can be handled by a single person and are used to form retaining wall structures by arranging a plurality of blocks in courses superimposed on each other, much like laying of brick or the like. Each block includes a body with a front face which forms the exterior surface of the formed retaining wall.

Modular wall blocks are formed of concrete, commonly mixed in a hatching plant with only enough water to hydrate the cement and hold the unit together. Such blocks are commercially made by a high-speed process which provides a mold box having only sides, without a top or bottom, positioned on top of a steel pallet which contacts the mold box to create a temporary bottom plate. A concrete distributor box brings concrete from the batcher and places the concrete in the mold box and includes a blade which levels the concrete across the open top of the mold box. A stripper/compactor is lowered into the open, upper end of the box and contacts the concrete to imprint the block with a desired pattern and compresses the concrete under high pressure. The steel pallet located at the bottom of the mold box resists this pressure.

A vibrator then vibrates the mold box to aid in concrete consolidation. After approximately two to four seconds, the steel pallet is moved away from the bottom of the mold box which has been positioned above a conveyor belt. The stripper/compactor continues to push on the formed concrete to push the formed modular wall block out of the mold box onto the conveyor belt. This process takes about seven to nine seconds to manufacture a single wall block. The formed wall block is cured for approximately one day to form the final product.

With this high-speed method of construction, it is not practical to embed short strips or tabs of grid-like material or the like in the blocks with portions extending therefrom in the manner of the pre-cast wall panels shown in the Tensar brochure, in order to enable interconnection with a grid-like reinforcing sheet material such as by a Bodkin-type connection or the like. Therefore, other means for securing the reinforcing grid to selected modular blocks used to construct a retaining wall have had to be devised. Most such techniques actually secure end portions of a sheet of reinforcing grid between layers of wall blocks, relying primarily on the weight of superimposed blocks to provide a frictional engagement of the reinforcing means with the retaining wall. The nature of the very rough surface of such cementitious modular wall blocks tends to abrade, and thereby weaken, a polymeric sheet reinforcing material at the very point of interconnection with the retaining wall. Moreover, and most importantly, reliance on the weight of superimposed blocks to provide the primary grid-to-block connection strength is ineffective during an earthquake or other such seismic event where vertical accelerations, i.e., the actually momentary lifting of upper courses of wall blocks, decrease or totally eliminate the weight of superimposed blocks, thereby significantly reducing or destroying the connection strength and jeopardizing the stability of the retaining wall and the soil mass retained thereby.

SUMMARY OF THE INVENTION

It is a primary object of this invention to provide a simple and inexpensive modular wall block system formed of a plurality of wall blocks and a highly effective grid connection device for securing extended lengths of grid-like reinforcing sheet material to the wall blocks.

An important object of this invention is to provide a grid-to-block connection device which does not rely in any significant way on the weight of superimposed courses of wall block or on a frictional engagement between the reinforcing grid material and the juxtaposed surfaces of the modular blocks.

A further object of this invention is the provisions of a modular wall block system for forming a retaining wall incorporating a connection device which provides a secure interconnection between a grid-like reinforcing sheet material and selected wallblocks, even during seismic events such as an earthquake or the like.

Yet another object of this invention is the provision of a modular wall block retaining wall system providing a total bearing grid-to-block engagement by virtue of a Bodkin-like grid connection device.

A preferred grid-like sheet reinforcing material may be made according to the techniques disclosed in the above-identified '798 patent. Preferably, uniaxially-oriented geogrid materials as disclosed in the '798 patent are used, although biaxial geogrids or grid materials that have been made by different techniques such as woven, knitted or netted grid materials formed of various polymers including the polyolefins, polyamides, polyesters and the like or fiberglass, may be used. In fact, any flexible sheet material with interstitial spaces capable of interconnection with the grid connection device of the instant invention in the manner disclosed herein are suitable. Such materials are referred to herein and in the appended claims as "polygrids".

According to a preferred embodiment of the instant inventive concepts, a modular wall block is formed with recesses or troughs in portions of its upper and/or lower surfaces to receive and retain a rigid grid connection device. The grid connection device is preferably secured to the wall block by retaining clips or the like, although pins or other protrusions may be used in lieu of, or in addition to the clips, to retain the grid connection device in association with the wall block during a vertical acceleration of the wall elements occuring during an earthquake or the like. Portions of the grid connection device extend beyond the rear face of the block so as to be selectively secured to lengths of a polygrid sheet material embedded in the backfill for reinforcement.

The grid connection device preferably includes a plurality of parallel bars or fingers, interconnected at their forward and rearward ends by perpendicularly-extending crossbars. The grid connection device may be formed of steel, aluminum, fiberglass, or even a high strength polymer capable of transferring load from the polygrid through the rear crossbar of the grid connection device to the modular wall block by a limited number of retaining means such as the clips and/or pins discussed herein. If a grid connection device having an upwardly curved rearward portion according to a preferred embodiment of this invention is used, a positive rotation of the grid connection device is achieved under load, without pinching the strands of the polygrid, so as to push down the grid connection device into the wall block and improve the mechanical engagement of the grid connection device with the modular wall block.

As disclosed in the '798 patent, a high strength geogrid may be formed by stretching an apertured plastic sheet material. Utilizing the uniaxial techniques, a multiplicity of molecularly-oriented elongated strands and transversely extending bars which are substantially unoriented or less-oriented than the strands are formed. The strands and bars together define a multiplicity of grid openings. With biaxial stretching, the bars are also formed into oriented strands. In either event, or when using other polygrid materials, the fingers of the grid connection device may be spaced apart several times the spacing between strands of the polygrid so that the strands of the polygrid may be bent and threaded between the bars of the grid connection device in a manner similar to the Bodkin connection discussed above. A connecting member, such as a tube or rod of a high strength material, is then threaded between the bent strands and the fingers of the grid connection device so as to quickly form a secure joint or connection tying the polygrid to the modular wall block retaining wall.

At a construction site, a plurality of modular wall blocks are stacked in vertically superimposed courses. Grid connection devices are secured within the recesses of selected wall blocks with elongated lengths of polygrid connected to the grid connection devices and stretched out and interlocked with the fill soil or aggregate. The strips of polygrid reinforce the wall fill so as to create a stable mass behind the retaining wall.

A totally mechanical interconnection is achieved between the modular block retaining wall and the extended lengths of polygrid through the grid connection device without the necessity for engaging portions of the polygrid between the courses of wall block. Therefore, the strength of the connection is totally independent of the weight of superimposed wall blocks or friction between the wall blocks and the polygrid which makes the connection more secure and positive, particularly in earthquake-prone sites. Connections which depend upon friction for their strength can also subject the material of the polygrid to undesirable deterioration caused by the contact of the rough wall block surfaces with the polygrid, particularly woven, knitted or netted polygrids.

It is contemplated that the modular wall block itself may be of any configuration. A standard wall block is generally about 8 inches high, 12 inches wide and 8 inches deep, weighing approximately 65 pounds. Such blocks commonly have a front face, a rear face, top and bottom surfaces and opposite side surfaces and may include through-holes or openings, pockets or recesses, and wall portions of various shapes to facilitate lifting the blocks, interconnecting the blocks side-to-side or top-to-bottom, and forming retaining walls of various configurations. Details of the wall block and the retaining wall formed therefrom do not form part of the instant inventive concepts, except with respect to the manner in which a polygrid material is secured thereto using the unique grid connection device of this invention.

The above and other objects of the invention, as well as many of the attendant advantages thereof, will become more readily apparent when reference is made to the following detailed description, taken in conjunction with the accompanying drawings.

DETAILED DESCRIPTION OF THE PREFERRED EMBODIMENTS

Figure 1:
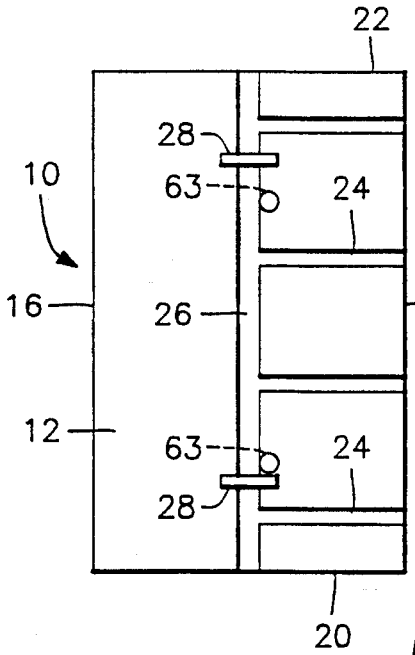
FIG. 1 is a schematic plan view of one surface of a modular wall block having recesses formed therein to receive a grid connection device according to the instant inventive concepts.
Figure 3:
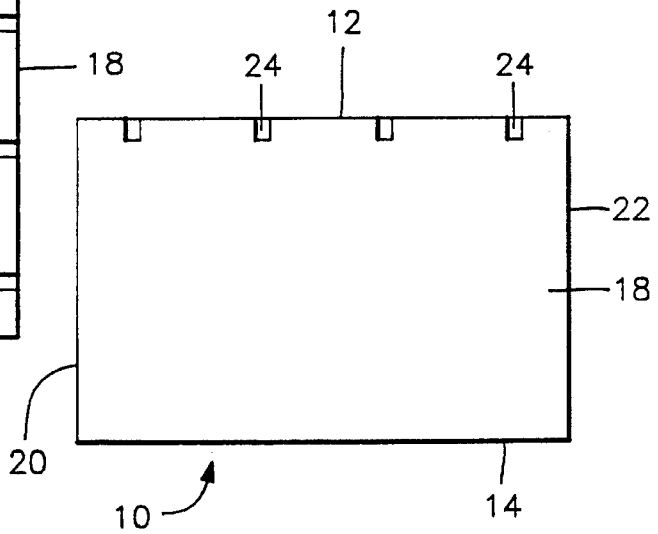
FIG. 3 is a rear elevational view thereof.
Figure 2:
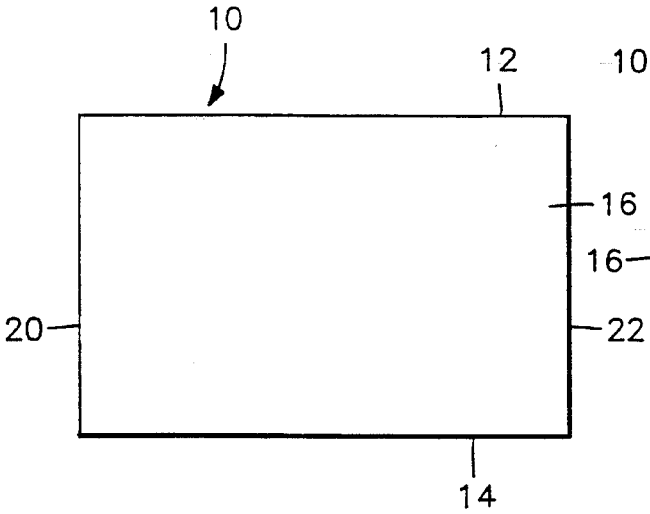
FIG. 2 is a front elevational view thereof.
Figure 4:
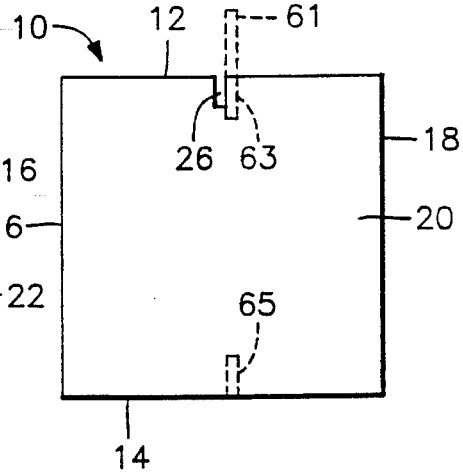
FIG. 4 is a side elevational view thereof.

In describing a preferred embodiment of the invention as illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

Although it is to be understood that the modular wall blocks of this invention may have a wide variety of end uses, a retaining wall formed by assembling a multiplicity of wall blocks in a manner such as to provide a vertical exterior facing surface is illustrated for convenience. However, as is well known, the blocks are commonly shifted slightly rearwardly and laterally offset or staggered in successive courses for stability and appearance. Likewise, the retaining wall may be straight, curved convexly or concavely, or formed in any other configuration. The front faces of the modular wall blocks can have any aesthetic or functional design. They can be planar, convex, concave, smooth, rough or have any configuration consistent with architectural or other requirements.

While the modular block itself is shown as generally rectangular with no surface characteristics except for the recesses designed to receive the grid connection device of this invention, any size or shape of modular wall block can be substituted therefor without departing from the instant inventive concepts.

Also, while the preferred embodiment hereof is described with reference to a uniaxially-oriented polymer geogrid such as is disclosed in the '798 patent, alternative grid-like tie-back reinforcing sheet materials may be substituted therefor, including polygrids manufactured using weaving, knitting or netting techniques.

With reference now to the drawings in general, and FIGS. 1 through 6 in particular, a modular wall block 10 is schematically shown as comprising an upper surface 12, a lower surface 14, a front face 16, a rear face 18 and opposite side surfaces 20, 22. In the embodiment shown, the upper surface 12 includes a plurality of recesses, grooves or troughs 24 extending generally parallel to each other. The recesses 24 extend to the rear face 18 from a generally perpendicularly-extending recess 26. Recesses 24 may be approximately one-half inch deep whereas recess 26 may be three-quarters inch deep if the preferred steel grid connection device described below is to be utilized therewith. While recesses are shown only in the upper surface 12 of the block 10, the recesses can be in the lower surface 14, or in both the upper and lower surfaces.

Figure 5:
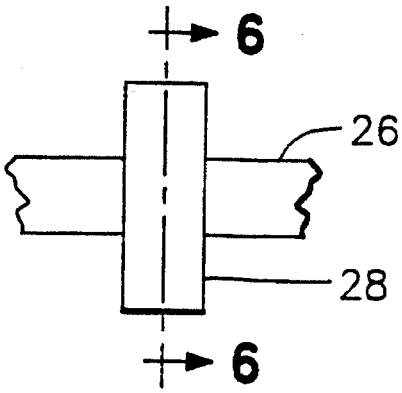
FIG. 5 is an enlarged elevational view of a detail showing the portion of the block defining a recess for reception of a retaining clip.
Figure 6:
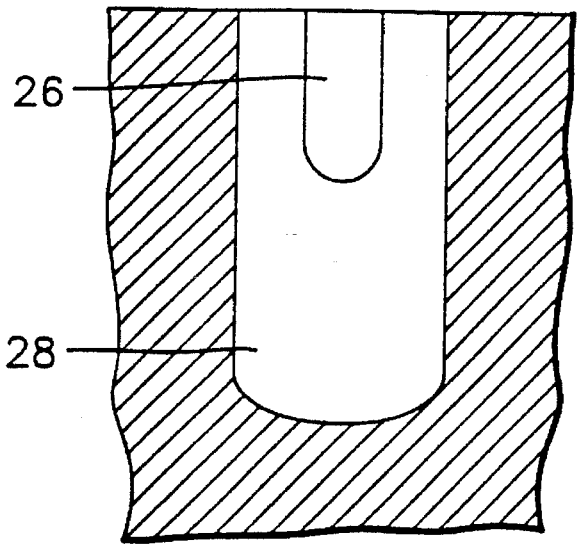
FIG. 6 is a cross-sectional view taken along lines 6—6 of FIG. 5.

Preferably, spaced along recess 26 and/or along recesses 24, if desired, are one or more recesses 28 for receipt of a retainer clip. As seen in FIGS. 5 and 6, the recesses 28 are wider and deeper than the recess 26 to frictionally receive the legs of a retainer clip as will be described hereinafter.

Figure 7:
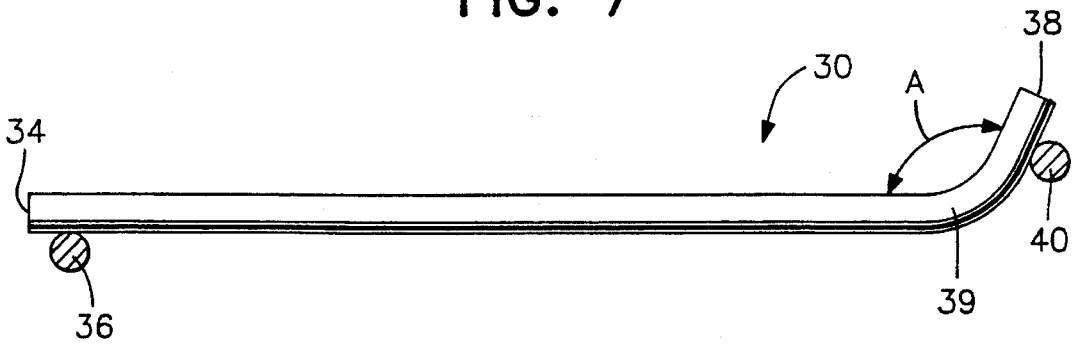
FIG. 7 is an enlarged side elevational view of a preferred form of grid connection device.
Figure 8:
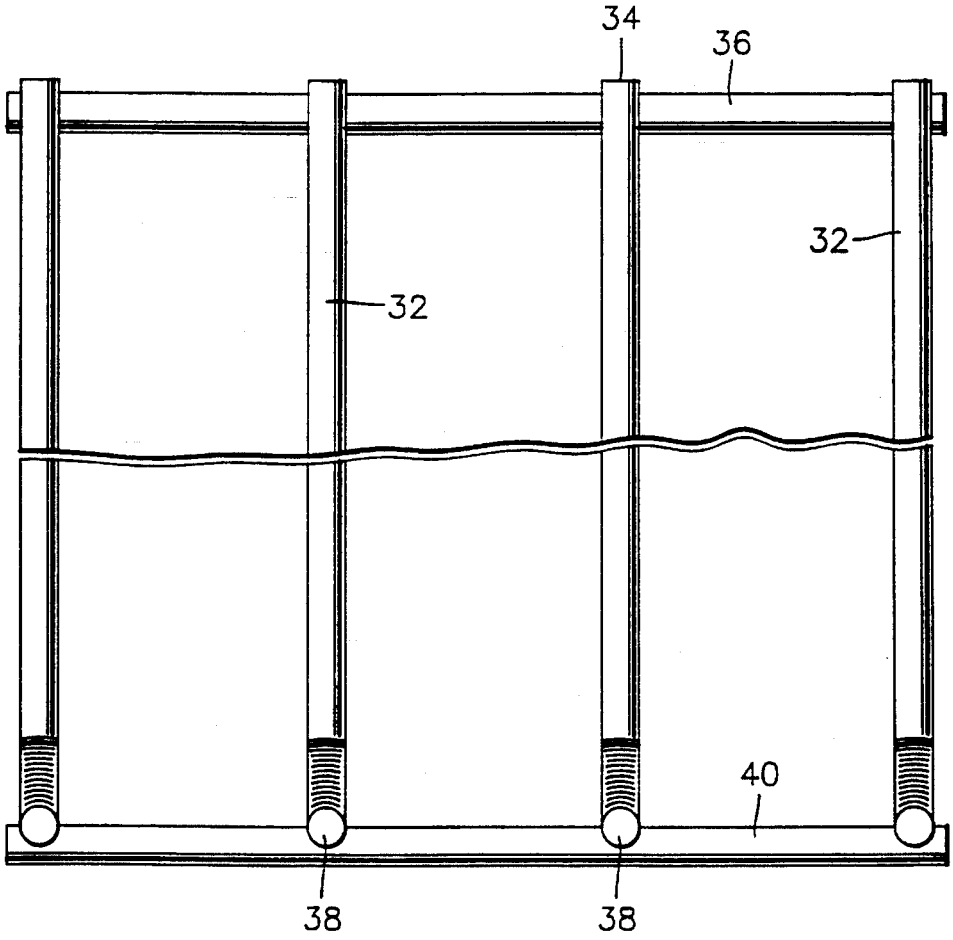
FIG. 8 is a top plan view of the grid connection device of FIG. 7, partially broken away for illustrative convenience.

Details of a preferred grid connection device 30 are shown primarily in FIGS. 7 and 8. The grid connection device 30 includes a plurality of fingers 32 extending substantially parallel to each other and interconnected at one end 34 by a crossbar 36. The crossbar 36 may be welded or secured in some other manner to the fingers 34 in the embodiment where the grid connection device 30 is made of steel.

At an opposite end 38 of the fingers 32 is located another crossbar 40 which is also welded or secured in some other manner to the fingers 32 in the event of the use of a steel connection device. In the preferred embodiment shown, the rearward end portions 39 of the fingers 32 are bent at an angle "A", preferably ranging between 60° and 70° with respect to a major portion of the remainder of the fingers 32. However, no bend of the device is necessary and a flat or straight grid connection device (not shown) will enable a Bodkin-type connection to a polygrid sheet as described below. However, when an upwardly bent rearward portion is provided, an improved grid-to-block connection is realized.

While the grid connection device 30 is shown as formed of welded steel elements, other rigid materials, including aluminum, fiberglass, or even high strength polymers may be substituted therefor. The fingers and crossbars of the grid connection device 30 may be secured together in any conventional manner. Alternatively, the grid connection device 30 may be integrally formed with fingers and crossbars as by stamping from a sheet of rigid material.

Figure 9:
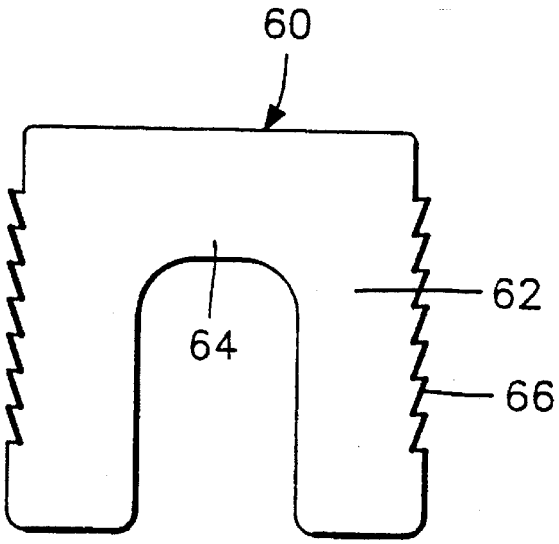
FIG. 9 is a front elevational view of one form of a grid connection device retaining clip according to this invention.
Figure 10:
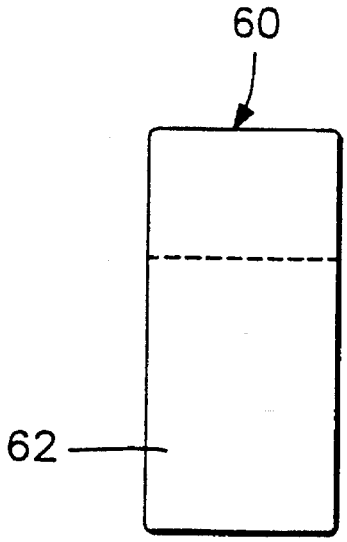
FIG. 10 is an end elevational view of the retaining clip of FIG. 9.

A retainer clip is shown at 60 in FIGS. 9 and 10 and comprises a generally U-shaped high strength plastic or steel element forming a pair of legs 62 interconnected by a bight portion 64. The legs 62 may have serrations 64 or the like 66 to frictionally engage the wall portions of the recess 28 of the block 10 in which they are secured. The crossbar 36 of the grid connection device 30 (or the fingers 32 depending on the location of the recesses 28) lies under, and is securely captured by, the bight portion 64 of the clip 60.

Additionally, or alternatively, pin elements 61 extending between holes 63, 65 provided in the upper and lower surfaces 12, 14 of superimposed wall blocks 10 (shown in dashed lines in FIGS. 1 and 4) may engage the grid connection device 30 to ensure that it is retained in position relative to the wall blocks, even when an upper course of wall blocks is lifted vertically during a seismic event.

Figure 11:
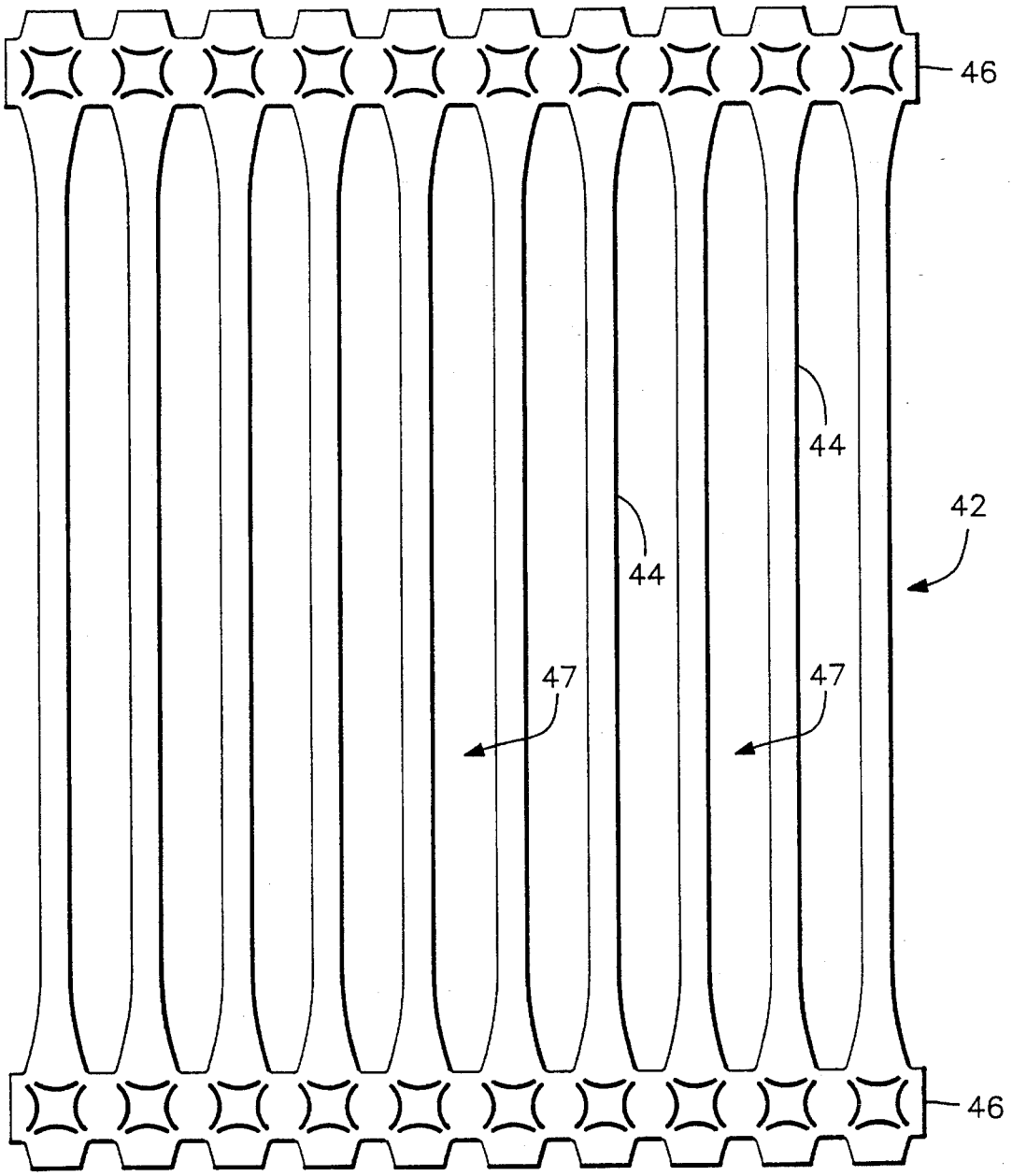
FIG. 11 is a top plan view of a section of one form of polygrid material which can be effectively secured to a modular block retaining wall according to the instant invention.

In FIG. 11, a portion of a polygrid 42 is shown which has been formed by uniaxially stretching an apertured sheet of polymer material according to the teachings of the '798 patent to form molecularly-oriented elongated strands 44 interconnected by unoriented or less-oriented and thicker junction bars 46. A plurality of openings 47 are defined between the strands 44 and bars 46. Geogrid section 42 is representative of an extended length of polygrid which is to be secured to a modular wall block 10 and typically measures four feet wide in the direction of the junction bars 46 and anywhere from four to twenty-five feet or more in length in the direction of the longitudinal axis of the strands 44.

Figure 12:
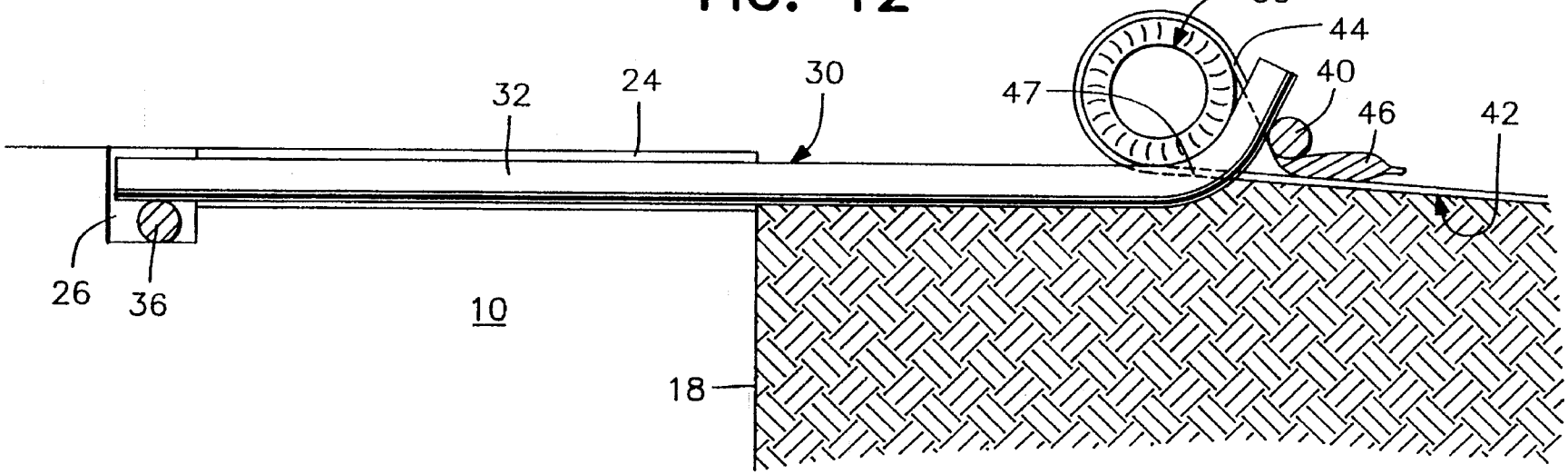
FIG. 12 is a schematic side view illustrating the manner in which a grid connection device is located within grooves in a surface of a modular wall block and functions to securely engage a polygrid material through a Bodkin-like connection according to the instant inventive concepts.
Figure 13:
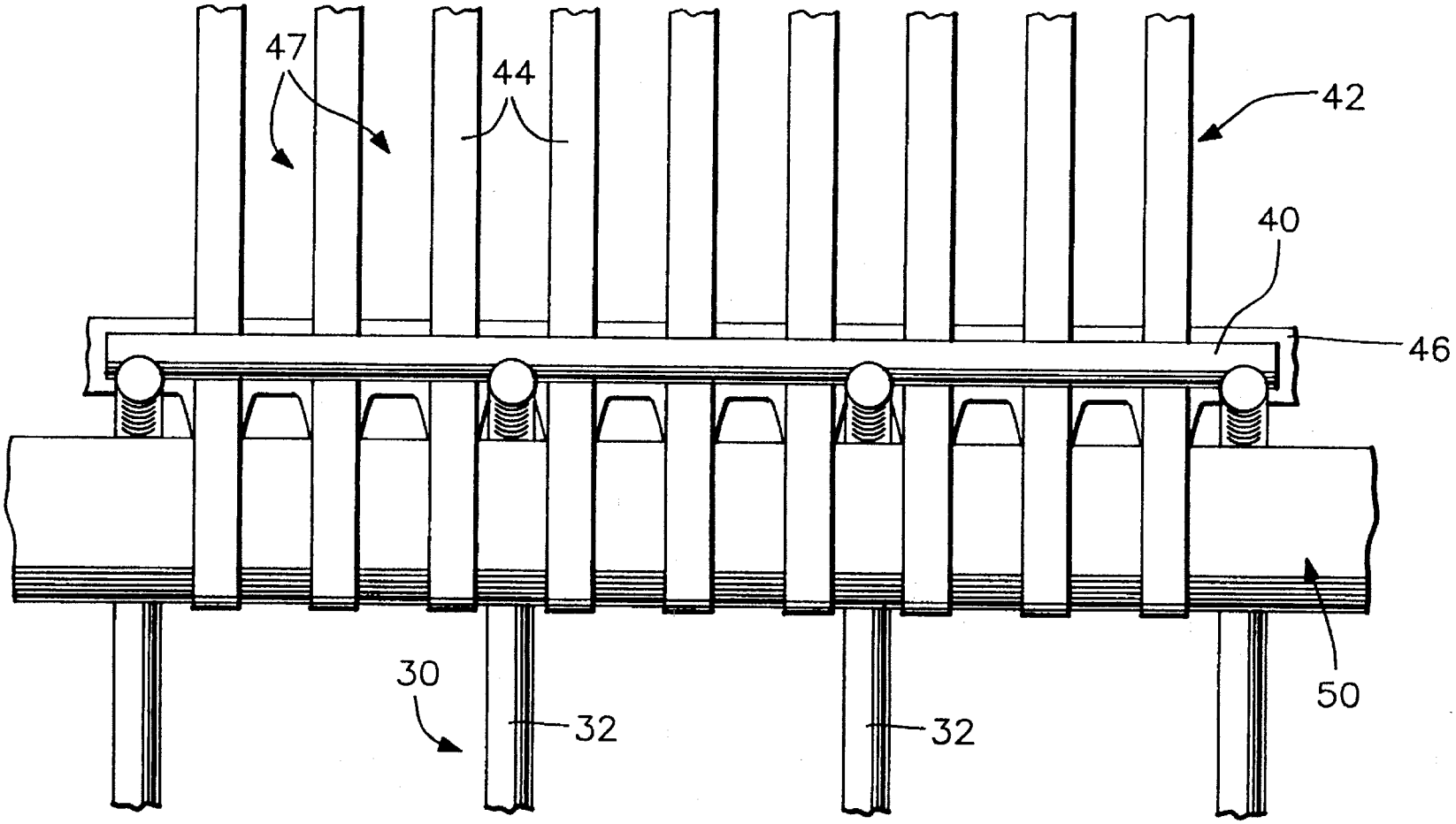
FIG. 13 is an enlarged schematic plan view of the connection between the polygrid and the grid connection device.
Figure 14:
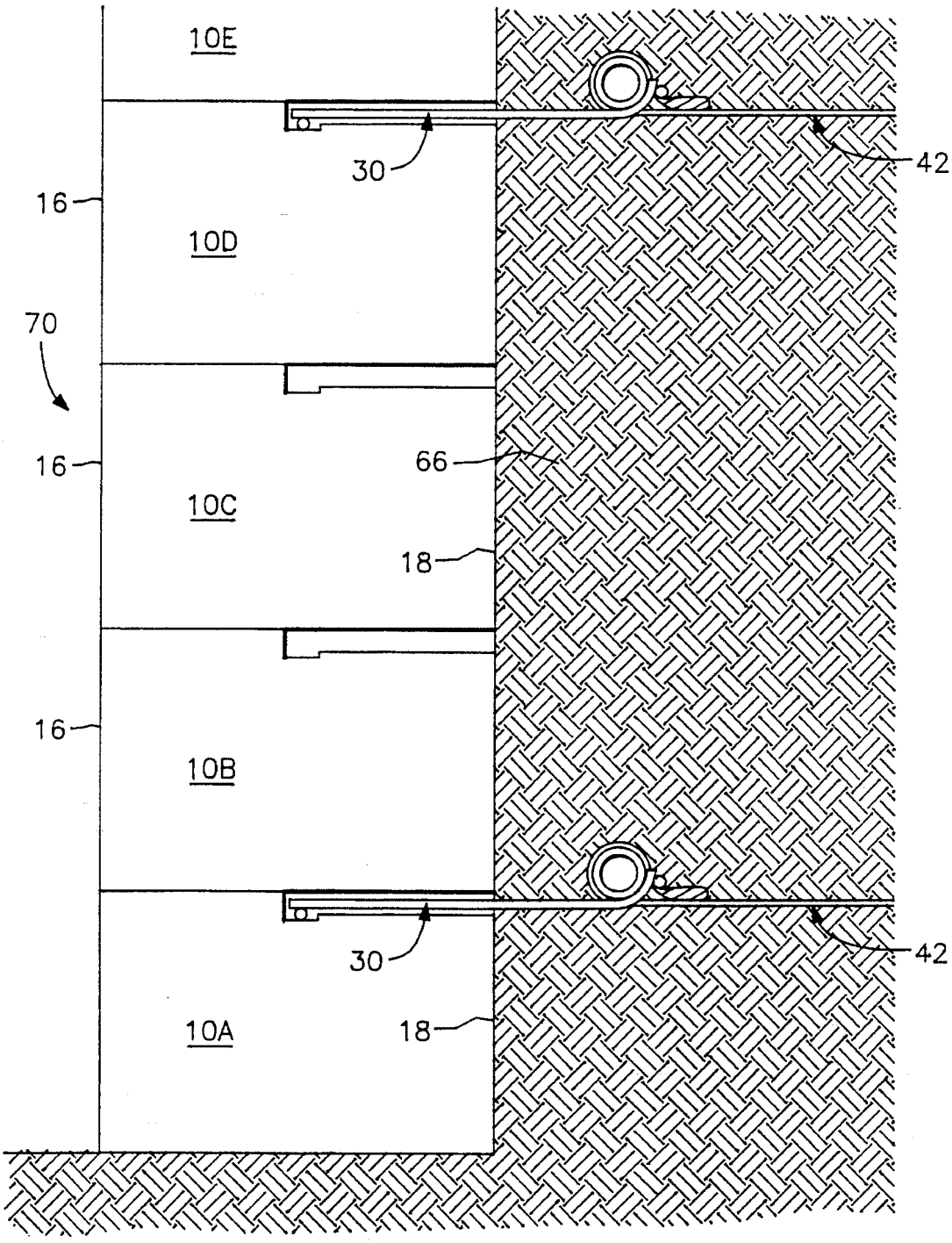
FIG. 14 is a side view similar to FIG. 12, showing a plurality of stacked courses of modular wall blocks forming a reinforced retaining wall according to this invention, with polygrid sheets connected to selected blocks.

FIGS. 12–14 illustrate the use of the components described above in constructing a retaining wall according to this invention. A lower course or row of modular wall blocks 10A is laid side-by-side in any desired configuration, depending upon the shape of retaining wall to be built. A grid connection device 30 is positioned in the recesses 24, 26 of selected blocks and secured therein with one or more clips 60 (and/or pins 61).

The rearward end of the grid connection device 30 extends past the rear wall 18 of the wall block 10A into the area where soil or other fill material 66 will be placed. An end of polygrid section 42 is bent and the strands 44 folded over so as to pass between adjacent fingers 32 of the connection device 30. A connection rod 50 which can be solid or hollow, formed of any strong material such as plastic or steel, is then passed through the loop formed by the bent-over ends of the polygrid section 42 and the polygrid section 42 is drawn taut and staked to lock the connection bar 50 in place, cradled within the curved angle "A" of the fingers 32 of the connection device 30 if the preferred embodiment of grid connection device having an upwardly curved rear end is used.

Additional courses of wall blocks 10B–E are positioned and polygrid connected to selected wall blocks in a similar manner until a retaining wall 70 having a plurality of exposed front faces 16 is formed. The area behind the rear faces 18 of the blocks 10 is progressively backfilled with soil or other aggregate as the courses are laid to secure the extended lengths of polygrid sections within the fill material. The polygrid functions to reinforce the fill and reduce the pressure on the retaining wall in a well known manner, Having described the invention, many modifications thereto will become apparent to those skilled in the art to which it pertains without deviation from the spirit of the invention as defined by the scope of the appended claims.

What is claimed is:

1. A modular wall block system used for forming a retaining wall comprising:

a plurality of wall blocks each having a front face for forming a portion of an exterior surface of the retaining wall, a rear face, top and bottom surfaces, and opposed side walls, a rigid grid connection means having forward and rearward end portions, recess means defined in at least one of said top and bottom surfaces of at least some of said wall blocks for removably receiving said forward end portions of said grid connection means with rearward end portions of said grid connection means extending beyond said rear face of said wall block, retaining means for securing said forward end portions of said grid connection means to said wall blocks, and said rearward end portions of said grid connection means being securable to a polygrid material.

2. A modular wall block system as claimed in claim 1, wherein said retaining means comprises clip means for securing said grid connection device in said recess means.

3. A modular wall block system as claimed in claim 2, wherein said clip means comprise U-shaped members including a pair of spaced leg elements interconnected by a bight portion, further recess means defined in said modular block for receiving leg elements of said clip means with said bight portions overlying and retaining portions of said forward end portions of said grid connection means.

4. A modular wall block system as claimed in claim 3, wherein said leg elements include serration means to frictionally secure said clip means in said further recess means.

5. A modular wall block system as claimed in claim 1, wherein said grid connection means is made of steel.

6. A modular wall block system as claimed in claim 1, wherein said forward portions of said grid connection means are retained in said recess means between parallel planes defined by said top and bottom surfaces.

7. A modular wall block system as claimed in claim 1 wherein said recess means are defined in said top surface of said wall block, and said grid connection means is retained in said recess means below the level of said top surface.

8. A modular wall block system as claimed in claim 1, wherein said grid connection means includes a plurality of generally parallel fingers connected by crossbars, said polygrid material to be secured to said rearward end portions by forming a loop upon itself which is interengaged with said fingers, and a rod means for passing through said loop to secure said polygrid material to said grid connection means.

9. A modular wall block system as claimed in claim 8, wherein said rearward end portions of said grid connection means are upwardly curved for cradling of said rod means.

10. A modular wall block system as claimed in claim 8, wherein said retaining means includes hole means defined in said top and bottom surfaces of each wall block in juxtaposition to the rearward edge of the recess means that will receive a crossbar of said grid connection means, and pin means for insertion into said hole means to extend between superimposed wall blocks.

11. A modular wall block system as claimed in claim 8, wherein said retaining means includes U-shaped clip members including a pair of spaced leg elements interconnected by a bight portion, further recess means defined in said modular block for receiving leg elements of said clip members with said bight portions overlying and retaining portions of said forward end portions of said grid connection means, and said retaining means further including hole means defined in said top and bottom surfaces of each wall block in juxtaposition to the rearward edge of the recess means that will receive a crossbar of said grid connection means, and pin means for insertion into said hole means to extend between superimposed wall blocks.

12. A retaining wall comprising:

a plurality of courses of superimposed wall blocks each having a front face forming a portion of an exterior surface of the retaining wall, a rear face, top and bottom surfaces, and opposed side walls, a rigid grid connection means having forward and rearward end portions, recess means defined in at least one of said top and bottom surfaces of at least some of said wall blocks configured to receive said forward end portions of said grid connection means with rearward end portions of said grid connection means extending beyond said rear face of said wall block, retaining means securing said forward end portions of said grid connection means to said wall blocks, and a polygrid material secured to said rearward end portions of said grid connection means.

13. A retaining wall as claimed in claim 12, wherein said retaining means comprises clip means for securing said grid connection device in said recess means.

14. A retaining wall as claimed in claim 13, wherein said clip means comprise U-shaped members including a pair of spaced leg elements interconnected by a bight portion, further recess means defined in said modular block, said leg elements of said clip means being secured in said further recess means with said bight portions overlying and retaining portions of said forward end portions of said grid connection device.

15. A retaining wall as claimed in claim 14, wherein said leg elements include serration means to frictionally secure said clip means in said further recess means.

16. A retaining wall as claimed in claim 12, wherein said grid connection means is made of steel.

17. A retaining wall as claimed in claim 12, wherein said forward portions of said grid connection means are retained in said recess means between parallel planes defined by said top and bottom surfaces.

18. A retaining wall as claimed in claim 12, wherein said recess means are defined in said top surface of said wall block, and said grid connection means is retained in said recess means below the level of said top surface.

19. A retaining wall as claimed in claim 12, wherein said grid connection means includes a plurality of generally parallel fingers connected by crossbars, said polygrid material being secured to said rearward end portions by forming a loop upon itself which is interengaged with said fingers, and a rod means passing through said loop to secure said polygrid material to said grid connection means.

20. A retaining wall as claimed in claim 19, wherein said rearward end portions of said grid connection means are upwardly curved for cradling of said rod means.

21. A retaining wall as claimed in claim 19, wherein said retaining means includes hole means defined in said top and bottom surfaces of each wall block in juxtaposition to the rearward edge of the recess means that will receive a crossbar of said grid connection means, and pin means extending between said hole means in superimposed wall blocks.

22. A retaining wall as claimed in claim 19, wherein said retaining means includes U-shaped clip members including a pair of spaced leg elements interconnected by a bight portion, further recess means defined in said modular block receiving leg elements of said clip members with said bight portions overlying and retaining portions of said forward end portions of said grid connection means, and said retaining means further including hole means defined in said top and bottom surfaces of each wall block in juxtaposition to the rearward edge of the recess means that will receive a crossbar of said grid connection means, and pin means extending between said hole means in superimposed wall blocks.

23. A modular wall block system used for forming a retaining wall comprising:

a plurality of wall blocks each having a front face for forming a portion of an exterior surface of the retaining wall, a rear face, top and bottom surfaces, and opposed side walls, a rigid grid connection means having forward and rearward end portions, recess means defined in at least one of said top and bottom surfaces of at least some of said wall blocks for removably receiving said forward end portions of said grid connection means with rearward end portions of said grid connection means extending beyond said rear face of said wall block, retaining means for securing said forward end portions of said grid connection means to said wall blocks, and a polygrid material secured to said rearward end portions of said grid connection means.

24. A modular wall block system as claimed in claim 23, wherein said retaining means comprises clip means for securing said grid connection device in said recess means.

25. A modular wall block system as claimed in claim 24, wherein said clip means comprise U-shaped members including a pair of spaced leg elements interconnected by a bight portion, further recess means defined in said modular block for receiving leg elements of said clip means with said bight portions overlying and retaining portions of said forward end portions of said grid connection means.

26. A modular block system as claimed in claim 25, wherein said leg elements include serration means to frictionally secure said clip means in said further recess means.

27. A modular wall block system as claimed in claim 23, wherein said grid connection means is made of steel.

28. A modular wall block system as claimed in claim 23, wherein said forward portions of said grid connection means are retained in said recess means between parallel planes defined by said top and bottom surfaces.

29. A modular wall block system as claimed in claim 23, wherein said recess means are defined in said top surface of said wall block, and said grid connection means is retained in said recess means below the level of said top surface.

30. A modular wall block system as claimed in claim 23, wherein said grid connection means includes a plurality of generally parallel fingers connected by crossbars, said polygrid material to be secured to said rearward end portions by forming a loop upon itself which is interengaged with said fingers, and a rod means for passing through said loop to secure said polygrid material to said grid connection means.

31. A modular wall block system as claimed in claim 30, wherein said rearward end portions of said grid connection means are upwardly curved for cradling of said rod means.

32. A modular wall block system as claimed in claim 30, wherein said retaining means includes hole means defined in said top and bottom surfaces of each wall block in juxtaposition to the rearward edge of the recess means that will receive a crossbar of said grid connection means, and pin means for insertion into said hole means to extend between superimposed wall blocks.

33. A modular wall block system as claimed in claim 30, wherein said retaining means includes U-shaped clip members including a pair of spaced leg elements interconnected by a bight portion, further recess means defined in said modular block for receiving leg elements of said clip members with said bight portions overlying and retaining portions of said forward end portions of said grid connection means, and said retaining means further including hole means defined in said top and bottom surfaces of each wall block in juxtaposition to the rearward edge of the recess means that will receive a crossbar of said grid connection means, and pin means for insertion into said hole means to extend between superimposed wall blocks.

* * * * *